US010111514B2

(12) United States Patent
King

(10) Patent No.: US 10,111,514 B2
(45) Date of Patent: Oct. 30, 2018

(54) RIGGING BAG

(71) Applicant: Douglas Karl King, Penfield, NY (US)

(72) Inventor: Douglas Karl King, Penfield, NY (US)

( * ) Notice: Subject to any disclaimer, the term of this patent is extended or adjusted under 35 U.S.C. 154(b) by 0 days.

(21) Appl. No.: 15/940,927

(22) Filed: Mar. 29, 2018

(65) Prior Publication Data

US 2018/0279745 A1 Oct. 4, 2018

Related U.S. Application Data

(60) Provisional application No. 62/478,265, filed on Mar. 29, 2017.

(51) Int. Cl.

| | |
|---|---|
| ***A62B 1/16*** | (2006.01) |
| ***A45F 3/04*** | (2006.01) |
| ***A45F 3/00*** | (2006.01) |
| ***B65D 37/00*** | (2006.01) |

(52) U.S. Cl.

CPC ..... *A45F 3/04* (2013.01); *A45F 3/005* (2013.01); *B65D 37/00* (2013.01); *A45F 2003/003* (2013.01); *A45F 2200/0575* (2013.01); *A62B 1/16* (2013.01)

(58) Field of Classification Search

CPC ..... A45F 3/005; A62B 1/16
USPC ..... D3/215, 226, 247, 232; 224/581, 660, 224/257, 600, 602, 607, 612, 622; 182/70

See application file for complete search history.

(56) References Cited

U.S. PATENT DOCUMENTS

| | | | | | |
|---|---|---|---|---|---|
| 720,467 | A * | 2/1903 | Oertel | A45C 1/06 | 150/117 |
| 3,676,882 | A * | 7/1972 | Lindqvist | B63C 9/26 | 441/85 |
| 4,515,300 | A * | 5/1985 | Cohen | A45C 1/04 | 224/153 |
| 4,662,517 | A * | 5/1987 | Wirth | B65H 75/362 | 206/388 |
| 4,713,033 | A * | 12/1987 | Cameron | B63C 9/26 | 206/388 |
| 5,439,154 | A * | 8/1995 | Delligatti | A45C 9/00 | 150/106 |
| 5,450,991 | A * | 9/1995 | Neading | A45F 3/00 | 224/250 |
| 5,544,792 | A * | 8/1996 | Arnwine | A45C 7/0086 | 224/153 |

(Continued)

*Primary Examiner* — Justin Larson

(57) ABSTRACT

A storage and carrying bag for climbing, rigging, and rescue gear that provides a user with quick and efficient access to stored gear. The bag includes a dual-compartment body, a first fastening mechanism, an at least one second fastening mechanism, a first strap, and a second strap. The dual-compartment body includes a first panel section, a middle panel section, and a second panel section. The first panel section and the second panel section are connected to the middle panel section on either side to delineate a zig-zag storage body. The first fastening mechanism is perimetrically integrated in between the first panel section and the middle panel section to delineate a first compartment. The second fastening mechanism is perimetrically integrated in between the second panel section and the middle panel section to delineate a second compartment. The first strap and the second strap are externally mounted to the dual-compartment body.

8 Claims, 4 Drawing Sheets

(56) References Cited

U.S. PATENT DOCUMENTS

| | | | | | |
|---|---|---|---|---|---|
| 5,570,824 | A * | 11/1996 | Lyon | A45F 3/00 | 224/148.5 |
| 5,868,219 | A * | 2/1999 | Sadeck | A62B 1/20 | 182/190 |
| D429,066 | S * | 8/2000 | Tucker | D3/226 | |
| 6,257,942 | B1 * | 7/2001 | Groover | B63C 9/26 | 441/84 |
| D449,445 | S * | 10/2001 | Arthur | D3/300 | |
| 6,516,920 | B1 * | 2/2003 | Schafler | A62B 1/16 | 182/190 |
| D483,940 | S * | 12/2003 | Dolan | D3/216 | |
| 6,880,702 | B1 * | 4/2005 | Colorado | A45F 3/02 | 206/388 |
| 7,191,925 | B2 * | 3/2007 | Aris | A45C 9/00 | 224/581 |
| D707,963 | S * | 7/2014 | Szewczyk | D3/232 | |
| 9,717,322 | B1 * | 8/2017 | Bergquist | A45F 4/02 | |
| 2001/0054633 | A1 * | 12/2001 | Marston | A45F 5/02 | 224/673 |
| 2003/0070818 | A1 * | 4/2003 | Hicks | A62B 3/00 | 169/43 |
| 2008/0087564 | A1 * | 4/2008 | Ciccotelli | A62C 99/00 | 206/388 |
| 2009/0095783 | A1 * | 4/2009 | Price | A45F 3/00 | 224/576 |
| 2011/0284324 | A1 * | 11/2011 | Schubert | A62B 1/06 | 182/70 |
| 2013/0206526 | A1 * | 8/2013 | Huff | A45C 13/00 | 190/110 |

* cited by examiner

RIGGING BAG

The current application claims a priority to the U.S. Provisional Patent application Ser. No. 62/478,265 filed on Mar. 29, 2017.

FIELD OF THE INVENTION

The present invention relates generally to accessories for rope, anchor, and climbing gear. More specifically, the present invention is a portable bag for various rope and rigging systems, in particular a set-of-four rope-and-pulley system. The present invention allows for quick and easy deployment

BACKGROUND OF THE INVENTION

The present invention looks to introduce an apparatus for a rigging bag that is an all-in-one "fall protection" or "travel restraint" unit. In particular, the present invention is designed to be utilized with a set-of-four rope-and-pulley system. The set-of-four rope-and-pulley system is a rope rigging system used for personnel rescue and emergency access operations. The set-of-four rope-and-pulley system provides the user with a four-to-one mechanical advantage in order to raise or lower personnel or various items. For rescue workers, gear weight and gear efficiency are one of the most important aspects as time is extremely sensitive in rescue operations and can be the deciding factor between life and death. Having a bag that is multiadaptive for various scenarios lets rescue workers carry less equipment, deploy system quickly, and be more efficient in general. Additionally, having a versatile bag allows rescue workers to adapt to various and continuously changing environments and situations. The present invention includes two separate storage compartments that in conjunction with the quick-release straps provide the user with the ability to deploy stored gear quickly and efficiently without readjusting or even moving the present invention.

The present invention differs from fanny packs currently being used in that when used in conjunction with a class belt, the wearer has an all-in-one "fall protection" or "travel restraint" in one unit. The other difference is that present invention can be worn in a belt configuration or over the shoulder and back like a bandolier without sacrificing functionality. When worn in the bandolier configuration, the wearer has access to the deployment straps on either end of the present invention, at the user's shoulder and waist.

DETAIL DESCRIPTIONS OF THE INVENTION

All illustrations of the drawings are for the purpose of describing selected versions of the present invention and are not intended to limit the scope of the present invention.

The present invention generally relates to accessories for climbing and rescue gear. More specifically, the present invention is a versatile bag design to store, transport, and facilitate the use of a set-of-four rope-and-pulley system, or other climbing and rescue gear. The present invention may be used as an all-in-one "fall protection" or "travel restraint" unit. Additionally, a user is capable of wearing the present invention in a belt configuration or over the shoulder configuration while still having access to gear held or stored by the present invention.

Figure 1:
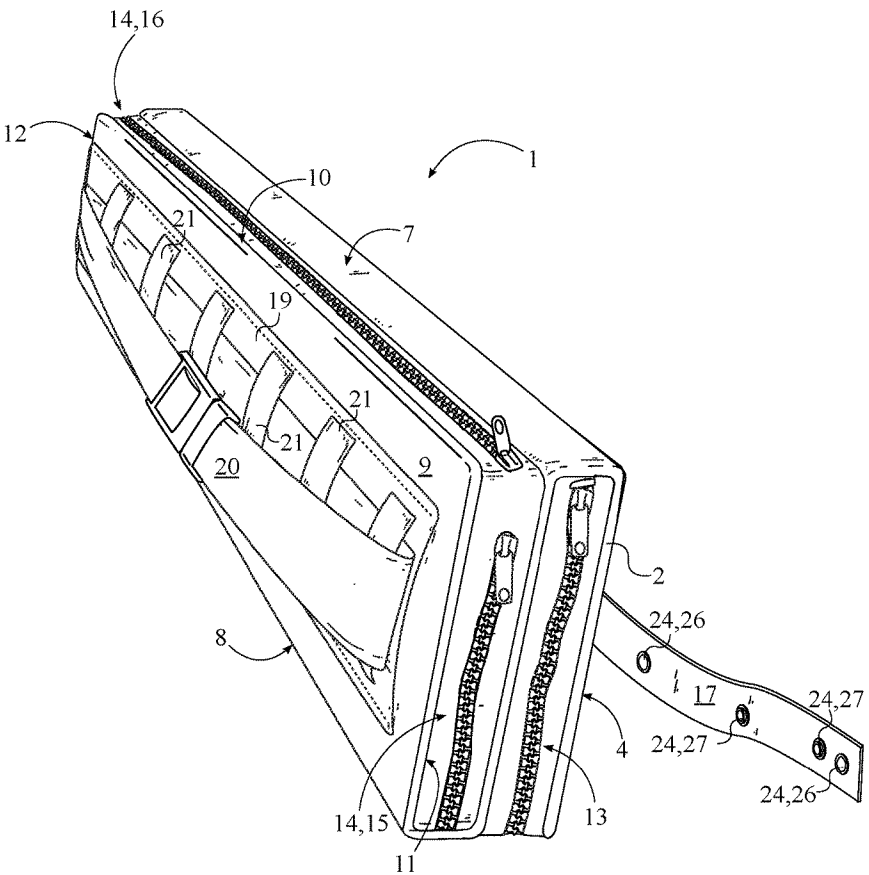
FIG. 1 is a left-side perspective view of the present invention.
Figure 2:
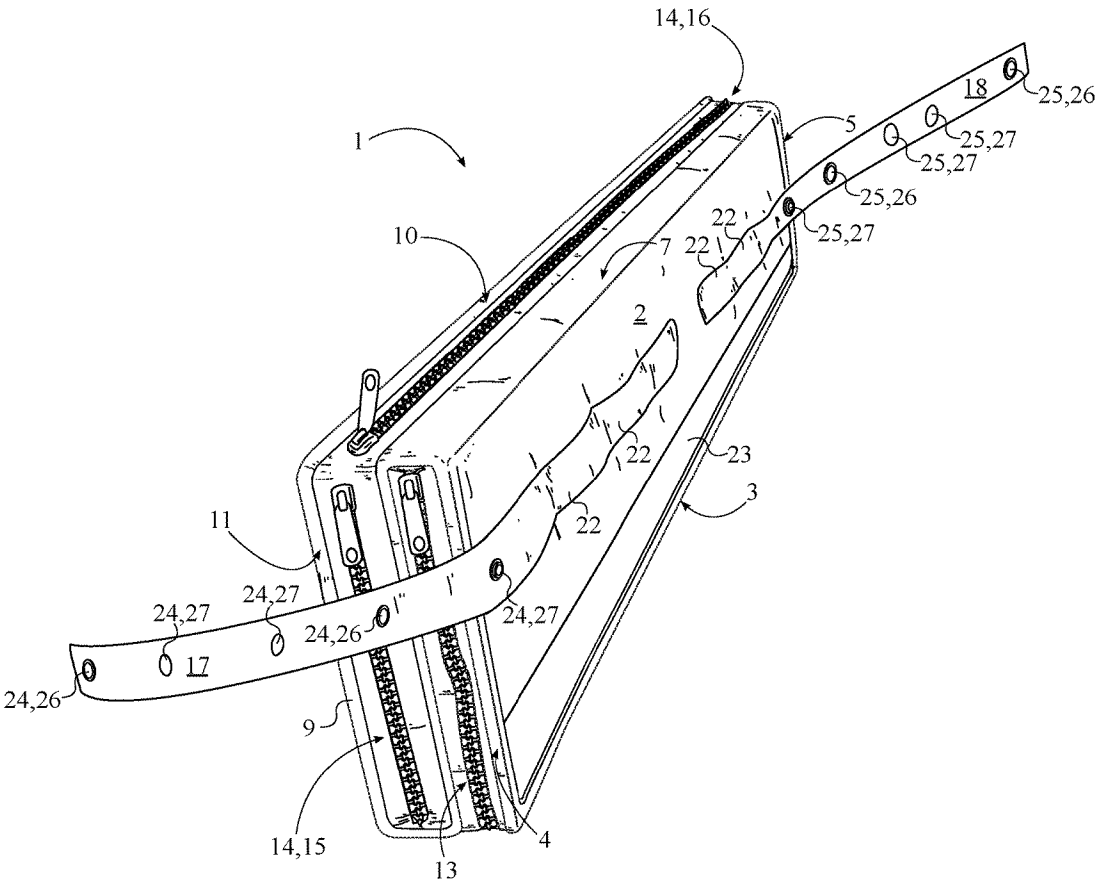
FIG. 2 is a right-side perspective view of the present invention.
Figure 4:
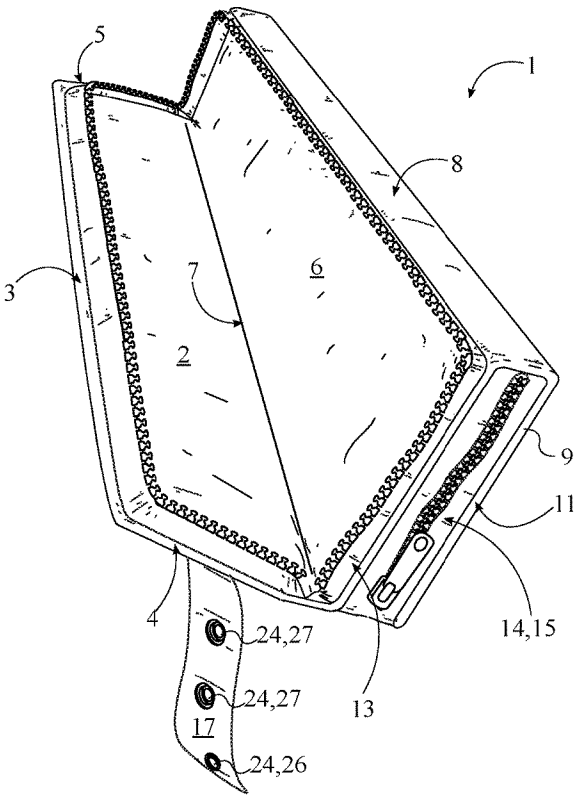
FIG. 4 is an alternative perspective view of the present invention in the open state.

Referring to FIG. 1 and FIG. 2, the present invention comprises a dual-compartment body 1, a first fastening mechanism 13, an at least one second fastening mechanism 14, a first strap 17, a second strap 18, and a belt sleeve 19. The dual-compartment body 1 is a non-rigid container with at least two separate storage compartments. The dual-compartment body 1 comprises a first panel section 2, a middle panel section 6, and a second panel section 9 as seen in FIG. 4. The first panel section 2, the middle panel section 6, and a second panel section 9 are each a sheet composed of a flexible fabric. Additionally, the first panel section 2, the middle panel section 6, and the second panel section 9 are identical in shape, size, and material composition. The two storage compartments are formed by configuring the first panel section 2, the middle panel section 6, and the second panel section 9 into a zig-zag pattern. More specifically, the first panel section 2 and the second panel section 9 are positioned opposite to each other across the middle panel section 6. A first lateral edge 7 of the middle panel section 6 is laterally connected along the first panel section 2. Resultantly, the first panel section 2 is folded adjacent to the middle panel section 6 to form and outline a first compartment. Additionally, the first panel section 2 is attached to the middle panel section 6 by the first fastening mechanism 13. In particular, the first fastening mechanism 13 is perimetrically integrated in between the first panel section 2 and the middle panel section 6. Similarly, a second lateral edge 8 of the middle panel section 6 is laterally connected along the second panel section 9. Resultantly, the second panel section 9 is folded against the middle panel section 6, opposite to the first panel section 2, to form and outline a second compartment. Additionally, the second panel section 9 is attached to the middle panel section 6 by the second fastening mechanism 14. In particular, the second fastening mechanism 14 is perimetrically integrated in between the second panel section 9 and the middle panel section 6. A variety of mechanisms may be used as the first fastening mechanism 13 and the second fastening mechanism 14 including, but not limited to, zippers, buttons, hook-and-loop fasteners, and other similar mechanisms.

The first strap 17 and the second strap 18 provide a quick and an efficient means for accessing stored gear from either the first compartment or the second compartment. The first strap 17 and the second strap 18 are each an elongated strip of fabric that are positioned opposite to each other along the dual-compartment body 1. The first strap 17 is externally mounted to the dual-compartment body 1 and provides quick access to gear within the first compartment. To utilize the quick access feature, a free end or a portion of the first strap 17 is attached/tethered to the stored gear within the first compartment and thus the free end or a portion of the first strap 17 is retained within the first compartment. This provides the user the ability to pull on the external/exposed portion of the first strap 17 in order to pull out and expose the stored gear within the first compartment. Mirroring the first strap 17, the second strap 18 is externally mounted to the dual-compartment body 1 and provides quick access to stored gear within the second compartment. To utilize the quick access feature, a free end or a portion of the second strap 18 is attached to the stored gear within the second compartment and thus the free end or a portion of the second strap 18 is retained within the second compartment.

Referring to FIG. 1, the belt sleeve 19 allows for the user to attach an external belt to the present invention such as a class 1 belt, thus approving the present invention as an all-in-one fall protection or travel restraint apparatus. The belt sleeve 19 is an elongated tubular structure composed of strong and reinforced fiber. The belt sleeve 19 is positioned along the second panel section 9, opposite the middle panel section 6. Additionally, the belt sleeve 19 is adjacently connected along the second panel section 9 such that an external belt, when utilized with the present invention, supports the length of the dual-compartment body 1. The size, dimensioning, and material composition of the belt sleeve 19 is subject to change to meet the needs and preferences of the user. In the preferred embodiment of the present invention, an internal surface of the belt sleeve 19 is preferably composed of a high-friction material such as shark skin. This ensures that the attached belt does not slide within the belt sleeve 19.

In one embodiment, referring to FIG. 1, the present invention further comprises an adjustable strap 18 and a plurality of belt loops 21 to provide the user with a built-in belt. The adjustable strap 18 is an at least one elongated strip of woven material designed to support the present invention and provide a means for carrying the present invention over the shoulder or around the waist. The plurality of belt loops 21 attaches the adjustable strap 18 to the dual-compartment body 1. The plurality of belt loops 21 is positioned adjacent to the second panel section 9, opposite the middle panel section 6, and is distributed along the second panel section 9. Additionally, each of the plurality of belt loops 21 is oriented perpendicular to the second panel section 9. Resultantly, the adjustable strap 18 is attached to the second panel section 9 oriented parallel to the dual-compartment body 1. Each of the plurality of belt loops 21 is adjacently mounted to the second panel section 9. It is preferred that each of the plurality of belt loops 21 is adjacently connected to the belt sleeve 19, either woven into the belt sleeve 19 or externally attached to the belt sleeve 19. The adjustable strap 18 traverses through each of the plurality of belt loops 21 to support the dual-compartment body 1 at incremental points along the length of the dual-compartment body 1. This ensures that the present invention is capable of supporting high loads, either dynamic or static. In the preferred embodiment of the present invention, the adjustable strap 18 includes a locking buckle to allow the user to easily attach and detach the present invention.

Figure 3:
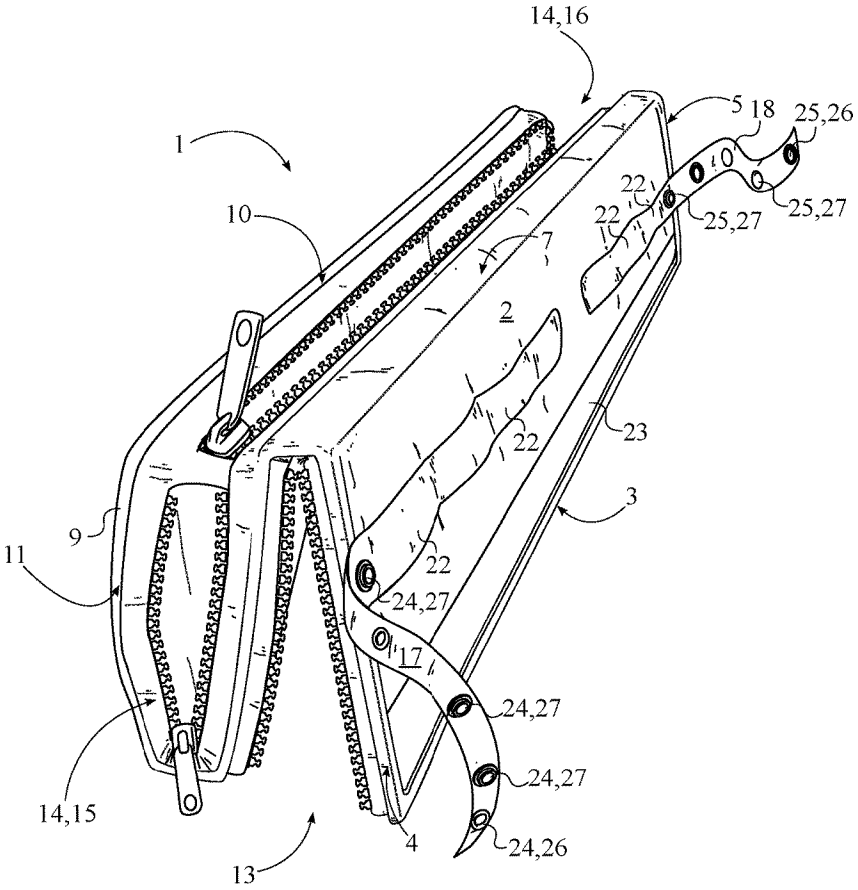
FIG. 3 is a right-side perspective view of the present invention in an open state.

Referring to FIG. 3, the present invention further comprises a plurality of gear loops 22. Each of the plurality of gear loops 22 is a piece of fabric configured into a circular geometry to provide the user with an attachment point for gear such as carabiners, belay devices, cams, gear pieces, ropes, hooks, and anchors to name a few non-limiting examples. The plurality of gear loops 22 is positioned adjacent to the first panel section 2, opposite the middle panel section 6 with the plurality of gear loops 22 being distributed along the first panel section 2. In order to ensure that the attached gear hangs perpendicular to the dual-compartment body 1, each of the plurality of gear loops 22 is oriented perpendicular to the first panel section 2. Each of the plurality of gear loops 22 is adjacently connected to the first panel section 2. Resultantly, when the present invention is worn around the waist, each of the plurality of gear loops 22 is oriented along the body of the user, similar to the gear loops of traditional climbing harnesses. In the preferred embodiment of the present invention, the plurality of gear loops 22 is formed by a portion of the first strap 17 and the second strap 18. In particular, the first strap 17 and the second strap 18 each extend along the dual-compartment body 1 and are incrementally attached at various points to form loop-like structures.

Referring to FIG. 3, the present invention further comprises an at least one reflective strip 23. The reflective strip 23 is an elongated piece of highly reflective material that provides the user with additional visual identification means. The reflective strip 23 is positioned adjacent to the first panel section 2, opposite the middle panel section 6. Additionally, the reflective strip 23 is adjacently connected along the first panel section 2 for maximum visibility and exposure. In alternative embodiments of the present invention, the at least one reflective strip 23 may comprise a plurality of strips for additional visibility from multiple angles.

The present invention also provides a means of attaching the first strap 17 and the second strap 18 to stored gear within the dual-compartment body 1. For this, the present invention further comprises a first button-clasp mechanism 24 and a second button-clasp mechanism 25, although other similar mechanisms may also be utilized. The first button-clasp mechanism 24 is integrated into the first strap 17 to allow the first strap 17 to be configurated into a looped state; the looped state acts as an attachment point for gear such as carabiners. Similarly, the second button-clasp mechanism 25 is integrated into the second strap 18 to allow gear to be attached to the second strap 18. Referring to FIG. 2, the first button-clasp mechanism 24 and the second button-clasp mechanism 25 each comprise a plurality of first interlocking elements 26 and a plurality of second interlocking elements 27. Each of the plurality of first interlocking elements 26 is an annular plate that receives and mechanically engages with the plurality of second interlocking element 27. Each of the plurality of second interlocking elements 27 is a disk with a central cylindrical protrusion sized to mechanically interlock within a central hole of one from the plurality of first interlocking elements 26. In alternative embodiments, alternative mechanisms may be used to configure the first strap 17 and the second strap 18 into the looped state including, but not limited to, hook-and-loop fasteners, buttons, and magnets.

For the first button-clasp mechanism 24, the plurality of first interlocking elements 26 is distributed along the first strap 17 to allow for multiple attachment points. In particular, each of the plurality of first interlocking elements 26 is integrated into the first strap 17. Similarly, the plurality of second interlocking elements 27 is distributed along the first strap 17. Each of the plurality of second interlocking elements 27 is integrated into the first strap 17. The location of the plurality of first interlocking elements 26 and the plurality of second interlocking elements 27 may vary to meet the needs and preferences of the user. Resultantly, portions of the first strap 17 may positioned into a loop by mechanically engaging a selected second element from the plurality of second interlocking elements 27 with a selected first element from the plurality of first interlocking elements 26. The formed loop allows gear and other similar devices being stored within the first compartment to be attached to the first strap 17 by a carabiner or other similar device. The first strap 17 and the first button-clasp mechanism 24 are the main components which provide the user with quick and easy access to gear being stored within the first compartment. To access said gear, the user simply pulls on the free end of the first strap 17 until the attached gear is exposed and out of the first compartment. To release the first strap 17 from the attached gear, the user simply tugs at the exposed portion of first strap 17 to disengage the first button-clasp mechanism 24. Resultantly, the user is able to access gear within the first compartment quickly, efficiently, and with a single arm.

For the second button-clasp mechanism 25, the plurality of first interlocking elements 26 is distributed along the second strap 18 to allow for multiple attachment points. In particular, each of the plurality of first interlocking elements 26 is integrated into the second strap 18. Similarly, the plurality of second interlocking elements 27 is distributed along the second strap 18. Each of the plurality of second interlocking elements 27 is integrated into the second strap 18. The location of the plurality of first interlocking elements 26 and the plurality of second interlocking elements 27 may vary to meet the needs and preferences of the user. Resultantly, portions of the second strap 18 may configured into a loop by mechanically engaging a selected second element from the plurality of second interlocking elements 27 with a selected first element from the plurality of first interlocking elements 26. The formed loop allows gear and other similar devices being stored within the second compartment to be attached to the second strap 18 by a carabiner or other similar device. The second strap 18 and the second button-clasp mechanism 25 are the main components which provide the user with quick and easy access to gear being stored within the second compartment. To access said gear, the user simply pulls on the exposed portion of the second strap 18 until the attached gear is exposed and out of the second compartment. To release the second strap 18 from the attached gear, the user simply tugs at the second strap 18 to disengage the second button-clasp mechanism 25. Resultantly, the user is able to access gear within the second compartment quickly, efficiently, and with a single arm.

In the preferred embodiment of the present invention, the first fastening mechanism 13 is a dual-slider zipper. For reference, the first panel section 2 comprises a third lateral edge 3, a first end edge 4, and a second end edge 5. More specifically, the third lateral edge 3 is positioned parallel and opposite to the first lateral edge 7 of the middle panel section 6, across the first panel section 2. The first end edge 4 and the second end edge 5 are connected in between the third lateral edge 3 of the first panel section 2 and the first lateral edge 7 of the middle panel section 6. More specifically, the first end edge 4 and the second end edge 5 are positioned parallel and opposite to each other across the third lateral edge 3. This outlines a rectangular geometry. Additionally, the first end edge 4 is positioned adjacent to the first strap 17. The first fastening mechanism 13 extends along the first end edge 4, the third lateral edge 3, and the second end edge 5. Resultantly, when the first fastening mechanism 13 is zipped up, an enclosed space is delineated by the middle panel section 6 and the first panel section 2. The dual-slider zipper allows for the first compartment to be partially kept open at either side of the dual-compartment body 1.

In the preferred embodiment of the present invention, the second fastening mechanism 14 comprises a first zipper 15 and a second zipper 16. The first zipper 15 and the second zipper 16 allow for the second compartment to be opened at either end. For reference, the second panel section 9 comprises a fourth lateral edge 10, a third end edge 11, and a fourth end edge 12. More specifically, the fourth lateral edge 10 is positioned parallel and opposite to the second lateral edge 8 of the middle panel section 6, across the second panel section 9. The third end edge 11 and the fourth end edge 12 are connected in between the fourth lateral edge 10 of the second panel section 9 and the second lateral edge 8 of the middle panel section 6. More specifically, the third end edge 11 and the fourth end edge 12 are positioned parallel and opposite to each other across the fourth lateral edge 10. This outlines a rectangular geometry. Additionally, the fourth end edge 12 is positioned adjacent to the second strap 18. The first zipper 15 extends along the third end edge 11 to provide access to the second compartment. The second zipper 16 extends along the fourth lateral edge 10 and the fourth end edge 12 to provide an additional access point to the second compartment. Resultantly, when the first zipper 15 and the second zipper 16 are positioned into a closed state, an enclosed space is delineated by the middle panel section 6 and the second panel section 9. The first zipper 15 and the second zipper 16 may be partially closed, thus creating opening in between the second panel section 9 and the middle panel section 6 for rope and gear to be exposed.

In the preferred embodiment of the present invention, the dual-compartment is composed of conduct 2000; the first fastening mechanism 13 and the second fastening mechanism 14 are each a heavy duty YKK zippers; and each of the plurality of belt loops 21 is reinforced for additional strength.

The present invention is designed to efficiently carry and utilize a set-of-four rope-and-pulley system. The set-of-four rope-and-pulley system traditionally comprises a set-of-four pulleys, a climbing/rescue rope, and a travel-restraint hardware/system. The rope is threaded through the set-of-four pulleys such that a mechanical advantage is achieved. The travel-restraint system is terminally attached to the rope to provide a means for anchoring the overall system. In order to utilize the present invention with the set-of-four rope-and-pulley system, first the set-of-four pulleys with a portion of the rope is positioned within the first compartment. Next, the first strap 17 is looped through and attached to any hardware from the set-of-four system, such as the blocks or loading carabiner depending on the preferences of the user; the first strap 17 is secured by the first button-clasp mechanism 24. Next, the residual rope with the travel-restraint system is positioned outside the dual-compartment body 1, adjacent to the first strap 17. The first compartment is then closed by the first fastening mechanism 13 to the point where only the first strap 17 and the rope traverse out of the first compartment. Next, the travel restraint is fed into the second compartment through an opening created by the first zipper 15. The travel restraint is then attached to the second strap 18 by the second button-clasp mechanism 25. Once the aforementioned rope is within the second compartment, the first zipper 15 and the second zipper 16 are positioned closed. More specifically, the first zipper 15 is closed until the portion of the rope running from the first compartment to the second compartment is exposed. The second zipper 16 is closed about the second strap 18.

To access and release the set-of-four system, the user first laterally tugs the first strap 17 initially to partially open the first fastening mechanism 13. Next, the user pulls on the first strap 17 until the desired hardware of the set-of-four system is outside the dual-compartment body 1. Finally, the user pulls on the first strap 17 until the first button-clasp mechanism 24 is released, thus allowing the user to pull out the set-of-four system and any additional necessary rope. Once the rope within the first compartment is exhausted, additional rope from the second compartment is provided to the user through the second zipper 16. The same process is used to access the travel-restraint with the second strap 18, except from the other side of the user's body. One of the main benefits of the present invention is quick and easy access to gear being stored within the dual-compartment body 1, either through the first strap 17 or the second strap 18. This is true when the present invention is worn in a belt-type configuration. This is also true when the present invention is worn over the shoulder, in a bandolier-type configuration. When worn in the bandolier-type configuration, the user may wear the present invention over either shoulder and still be able to access the gear within the dual-compartment body 1. Furthermore, the user may alter the location of the gear within the present invention to meet the his or her personal preferences and needs, i.e. customizing the present invention into a right-handed configuration or a left-handed configuration.

Although the invention has been explained in relation to its preferred embodiment, it is to be understood that many other possible modifications and variations can be made without departing from the spirit and scope of the invention as hereinafter claimed.

What is claimed is:

1. A rigging bag comprises:

a dual-compartment body;

a first fastening mechanism;

an at least one second fastening mechanism;

a first strap;

a second strap;

the dual-compartment body comprises a first panel section, a middle panel section, and a second panel section;

the first panel section and the second panel section being positioned opposite to each other across the middle panel section;

a first lateral edge of the middle panel section being laterally connected along the first panel section;

a second lateral edge of the middle panel section being laterally connected along the second panel section;

the first fastening mechanism being perimetrically integrated in between the first panel section and the middle panel section;

the second fastening mechanism being perimetrically integrated in between the second panel section and the middle panel section;

the first strap and the second strap being positioned opposite to each other along the dual-compartment body;

the first strap being externally mounted to the dual-compartment body; and the second strap being externally mounted to the dual-compartment body; wherein the at least one second fastening mechanism comprises a first zipper and a second zipper; the second panel section comprises a fourth lateral edge, a third end edge, and a fourth end edge; the fourth lateral edge being positioned parallel and opposite to the second lateral edge of the middle planer section, across the second panel section; the third end edge and the fourth end edge being positioned parallel and opposite to each other across the fourth lateral edge; the fourth end edge being positioned adjacent to the second strap; the first zipper extending along the third end edge; and the second zipper extending along the fourth lateral edge and the fourth end edge.

2. The rigging bag as claimed in claim 1 comprises:

a belt sleeve;

the belt sleeve being positioned along the second panel section, opposite the middle panel section; and the belt sleeve being adjacently connected along the second panel section.

3. The rigging bag as claimed in claim 1 comprises:

an adjustable strap;

a plurality of belt loops;

the plurality of belt loops being position adjacent to the second panel section, opposite the middle panel section;

the plurality of belt loops being distributed along the second panel section;

each of the plurality of belt loops being oriented perpendicular to the second panel section;

each of the plurality of belt loops being adjacently mounted to the second panel section; and the adjustable strap traversing through each of the plurality of belt loops.

4. The rigging bag as claimed in claim 1 comprises:

a plurality of gear loops;

the plurality of gear loops being positioned adjacent to the first panel section, opposite the middle panel section;

the plurality of gear loops being distributed along the first panel section;

each of the plurality of gear loops being oriented perpendicular to the first panel section; and each of the plurality of gear loops being adjacently connected to the first panel section.

5. The rigging bag as claimed in claim 1 comprises:

an at least one reflective strip;

the reflective strip being positioned adjacent to the first panel section, opposite the middle panel section; and the reflective strip being adjacently connected along the first panel section.

6. The rigging bag as claimed in claim 1 comprises:

a first button-clasp mechanism;

the first button-clasp mechanism comprises a plurality of first interlocking elements and a plurality of second interlocking elements;

the plurality of first interlocking elements being distributed along the first strap;

each of the plurality of first interlocking elements being integrated into the first strap;

the plurality of second interlocking elements being distributed along the first strap;

each of the plurality of second interlocking elements being integrated into the first strap; and a selected second element from the plurality of second interlocking elements being mechanically engaged to a selected first element from the plurality of first interlocking elements.

7. The rigging bag as claimed in claim 1 comprises:

a second button-clasp mechanism;

the second button-clasp mechanism comprises a plurality of first interlocking elements and a plurality of second interlocking elements;

the plurality of first interlocking elements being distributed along the second strap;

each of the plurality of first interlocking elements being integrated into the second strap;

the plurality of second interlocking elements being distributed along the second strap;

each of the plurality of second interlocking elements being integrated into the second strap; and a selected second element from the plurality of second interlocking elements being mechanically engaged to a selected first element from the plurality of first interlocking elements.

8. The rigging bag as claimed in claim 1 comprises:

the first fastening mechanism being a dual-slider zipper;

the first panel section comprises a third lateral edge, a first end edge, and a second end edge;

the third lateral edge being positioned parallel and opposite to the first lateral edge of the middle panel section, across the first panel section;

the first end edge and the second end edge being positioned parallel and opposite to each other across the third lateral edge;

the first end edge being positioned adjacent to the first strap; and the dual-slider zipper extending along the first end edge, the third lateral edge, and the second end edge.

* * * * *